United States Patent [19]

Nygard et al.

[11] 4,393,804

[45] Jul. 19, 1983

[54] APPARATUS FOR REMOVING TONER FROM AND APPLYING OFFSET PREVENTIVE LIQUID TO A FIXING ROLLER

[75] Inventors: James C. Nygard, Maplewood; Melvin P. Weiss, Woodbury; Thomas E. Larsen, St. Paul, all of Minn.

[73] Assignee: Minnesota Mining and Manufacturing Company, St. Paul, Minn.

[21] Appl. No.: 320,545

[22] Filed: Nov. 12, 1981

[51] Int. Cl.[3] ..... B05C 11/00

[52] U.S. Cl. ..... 118/60; 118/70; 118/104; 355/3 FU; 432/60; 432/75

[58] Field of Search ..... 118/60, 70, 203, 104; 432/60, 75; 355/3 FU

[56] References Cited

U.S. PATENT DOCUMENTS 3,941,558 3/1976 Takiguchi ..... 432/60

4,277,161 7/1981 Calabrese ..... 355/3

*Primary Examiner*—Evan K. Lawrence

*Attorney, Agent, or Firm*—Cruzan Alexander; Donald M. Sell; Robert L. Marben

[57] ABSTRACT

Apparatus to apply offset preventing liquid to a fixing roller. A web member is moved from a supply core to a take-up core via a pressure roller positioned to establish a contact nip for the web member with the fixing roller. The web member is supplied with the liquid from an offset preventing liquid applicator positioned to contact the web member between the supply core and the contact nip on the surface of the web member that is brought into contact with the fixing roller.

10 Claims, 2 Drawing Figures

APPARATUS FOR REMOVING TONER FROM AND APPLYING OFFSET PREVENTIVE LIQUID TO A FIXING ROLLER

BACKGROUND OF THE INVENTION

The invention presented herein relates to contact fixing stations for an imaging apparatus wherein the image is formed by toner particles carried on a receptor sheet which are permanently adhered to the receptor sheet at a fixing station of the apparatus and more particularly to the apparatus for removing toner material that is offset to a rotating fixing roller of the fixing station and for applying offset preventive liquid to the fixing roller.

The use of toner particles for forming images on a receptor sheet in various image forming machines, such as office copiers and the like, requires a fixing station within the machine for permanently adhering the toner particles to the receptor sheets. Apparatus for fixing stations which use contact with the toner particles to permanently affix the toner material to the receptor sheet utilize a fixing roller, which contacts the toner, and a back-up roller, at least one of which is driven, to move the receptor sheet between the rollers. One approach relies on the application of heat to the toner material via the fixing roller which is maintained at a temperature sufficient to elevate the temperature of the toner material to a point where the constituents of the toner material coalesce and become tacky. This action causes the toner material to be absorbed to some extent into the fibers of the receptor sheet material which, in many instances, constitutes plain paper. Thereafter, as the toner material cools, solidification of the toner material occurs causing the toner material to be permanently bonded to the receptor sheet. By controlling the heat transfer to the toner, virtually no offset of the toner particles from the receptor sheet to the fixing roller is experienced under normal conditions. By careful control of the heat transferred to the toner material, the heat applied to the surface of the fixing roller will not raise the temperature of the surface of the fixing roll above the "hot offset" temperature of the toner particles, which, if present, would cause a splitting action of the toner to result in "hot offset". Splitting occurs when the cohesive forces holding the heated toner particles together are less than the adhesive forces tending to offset it to the contacting surface of the fixing roller. Toner particles can also be offset to the fixing roller by an insufficient application of heat to the toner particles (i.e. "cold" offsetting); by imperfections in the properties of the surface of the fixing roll or by the toner particles insufficiently adhering to the receptor sheet by the forces which normally hold them to the receptor sheet. In such a case, toner particles may be transferred to the surface of the fixing roller with subsequent transfer to the backup roller during periods of time when a receptor sheet is not in the nip presented between the rollers.

One arrangement for minimizing the "offsetting" problem utilizes a fixing roller with an outer surface or covering of a material that is resistant to the high temperatures involved and will accept an offset preventive liquid, such as silicone oil, which is applied to the outer surface of the fixing roller. The silicone oil forms an interface between the fixing roller surface and the toner images carried on the receptor sheet. The relatively low surface energy of the silicone oil, which is presented to the toner, prevents the toner particles from offsetting to the fixing roller surface. Even with the use of the special coverings for the fixing roller and the application of silicone oil to the covering, some "non-visual offsetting" (i.e. offsetting of very fine particles of toner) does occur. Such "offsetting" causes degradation of the copy and in the case of a heated fixing roller, reduces its operating life.

Another fixing station of the contact type applies pressure to the toner particles to permanently affix the toner particles to the receptor sheet. As in the case of the heated fixing roller, some toner is offset to the fixing roller making contact with the toner particles in a pressure fixing apparatus even though an offset preventive liquid, such as silicone oil, is applied to the outer surface of the fixing roller.

The offsetting problem presented by contact type fixing stations has been solved to a degree by the employment of various oiler/cleaner arrangements for the fixing roller. Wick material supplied with silicone based oil from an oil supply has been employed for applying the silicone based oil to the fixing roller and for cleaning the fixing roller. Another known arrangement uses an oil applicator roller covered with an oil absorbent material that is periodically supplied with oil from an oil supply. Web material, which has been impregnated with silicone oil, has been used which is presented to the fixing roller to provide silicone oil to the outer surface of the fixing roller and also remove any toner material that may be present on the fixing roller.

The prior art arrangements mentioned for cleaning and applying offset preventing liquid to the fixing roller have not been entirely satisfactory. In the case of wick plus oil supply arrangements, an excessive amount of oil can build up in the wick during inactive periods causing too much oil to be applied to the fixing rollers. A wick clogging problem due to the toner removed is also presented when an oil supply plus wick arrangement is used. While this is overcome by the use of an arrangement using an oil impregnated web material, an oil migration problem is presented when a supply roll of oil impregnated web material is used. The oil migration problem is minimized by the use of higher viscosity oils (12,000 centistoke), and a heavier weight web to prevent tearing. Such corrective action, however, reduces the web's effectiveness as a cleaner and oiler for the fuser roller. Finally, the prior known arrangement using an oil supply plus an oil applicator roller covered with an oil absorbing material requires the use of a complicated arrangement for supplying a controlled oil to the covered roller. If the amount of oil supplied to the fixing roll is not carefully controlled, excessive oil will transfer to the image receptor making a copy objectionable.

SUMMARY OF THE INVENTION

The invention presented herein provides an arrangement which eliminates the oil migration and clogged wick problems present in prior art arrangements. In addition, it reduces the amount of oil used in that a very thin, but uniform, oil layer can be applied and applied consistently by the apparatus of the present invention. This also improves the quality of the image copies produced since less oil on the fixing roller results in less oil being carried away by the image copies. The oil consumption is estimated to be improved by a factor in excess of five over that provided by the known oiler/-cleaner arrangement using a roller covered with an oil absorbing material. In addition to being a factor with respect to copy quality, oil consumption is a factor from the standpoint of the size of the oil supply that is needed when an oiler/cleaner arrangement must be provided for a high volume copy machine.

The oiler/cleaner arrangement for a fixing roller of the present invention includes a web member that is adapted to be moved between a supply core and a take-up core via a pressure roller having an outer layer of resilient material with the pressure roller positioned to provide a contact nip for the web member with the fixing roller. An offset preventive liquid applicator means positioned between the supply core and the contact nip applies offset preventive liquid to the surface of the web member that is brought into contact with the fixing roller at the contact nip. The pressure roller and take-up core are adapted to be driven with the take-up core driven via a slip-clutch and at a speed greater than the speed of the pressure roller to place tension on the web material sufficient to prevent slippage of the web member relative to the pressure roller. The pressure roller is adapted to be rotated opposite to the direction of rotation of the fixing roller at the contact nip between the web member and the pressure roller so any toner that is removed from the fixing roller by the web member is carried away from and not into the contact nip. The invention presented herein also provides control over the amount of oil that is presented to the surface of the web member by offset preventive liquid applicator means having wick that contacts the web member wherein the wick is partially immersed in a reservoir of the liquid which is automatically maintained at an essentially constant level.

BRIEF DESCRIPTION OF THE DRAWING

The invention presented herein will be best understood by reference to the following description taken in connection with the accompanying drawing wherein.

DETAILED DESCRIPTION

Figure 1:
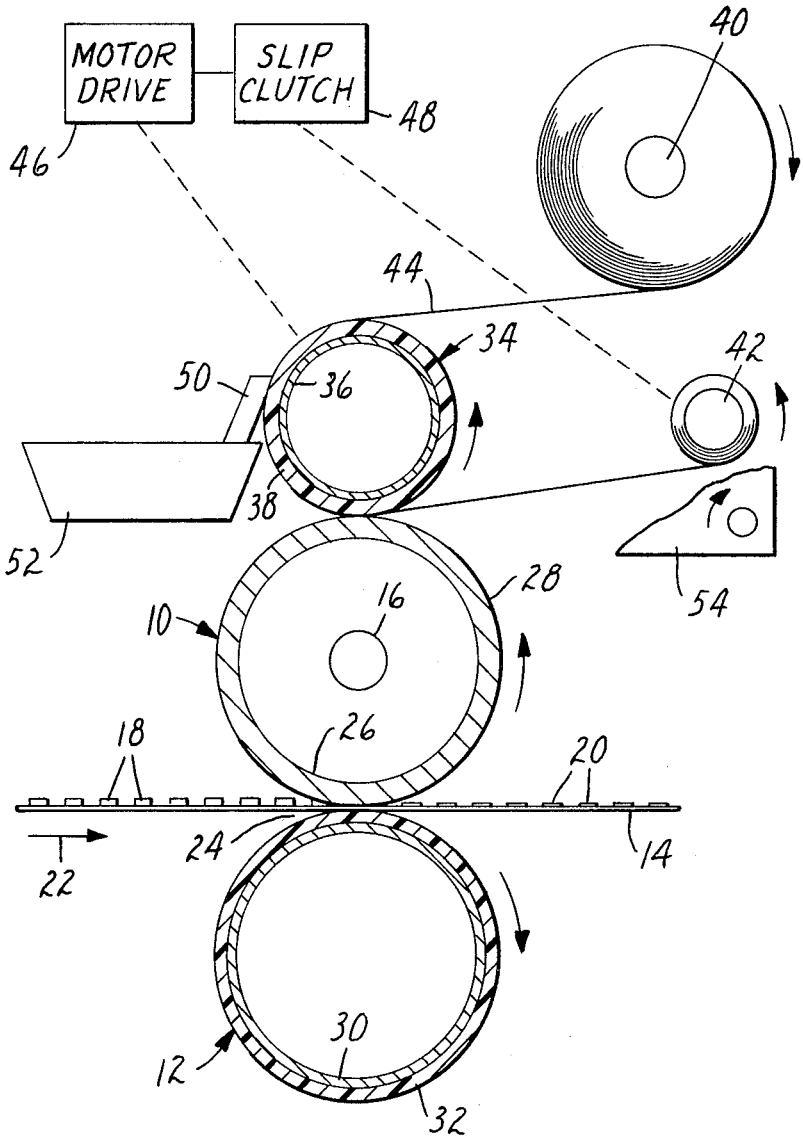
FIG. 1 is a diagramatic cross-sectional (partial) showing of apparatus embodying the invention.

Referring to the drawing, a heated fixing roller 10 and a backup roller 12, parts for a contact type fusing station for an imaging apparatus which produces images formed by toner particles placed on a receptor sheet, are shown in cross section together with a receptor sheet 14. The fixing roller 10 includes a metal cylindrical portion 28 and a tubular infrared bulb 16 centrally positioned within the portion 28 for supplying thermal energy for the roller 10. An image represented by unfixed toner particles 18 carried on the upper surface of the sheet 14 is shown with the fused or fixed toner image shown at 20. The sheet 14 is shown as it is passed in the direction indicated by arrow 22 through a nip 24 formed by the fixing roller 10 and backup roller 12. The toner image is thermally fixed at the nip 24 by the thermal energy supplied to the toner by the heated fixing roller 10 as the fixing roller 10, which is arranged to be driven in a direction opposite to that of the backup roller 12, moves the sheet 14 through the nip 24. In FIG. 1, roller 10 is shown to be driven counterclockwise with roller 12 driven clockwise to move sheet 14 from left to right. The fixing roller 10 also includes a thin outer coating (not shown) for the cylindrical portion 28 which is heat resistant, compatible with an offsetting preventing material, such as silicone oil, and has a low affinity for toner particles and the receptor sheet 14. The coating need only be 2 to 3 mils thick. A suitable coating may be sprayed on the portion 28 using a solution of catalyzed silicone gum and resin as taught in U.S. Pat. No. 3,809,854 to J. F. Sanders. The backup roller 12 can be formed from a metal cylinder 30 on which a layer 32 of silicone rubber is carried. The layer 32 can be provided with a thin overcoat (not shown) similar to that used for the fixing roller 10.

The remainder of the structure shown in FIG. 1 concerns the apparatus which serves to apply a thin coating of offsetting preventive liquid, such as silicone oil, to the outer surface of the fixing roller 10 and remove any toner particles from the fixing roller 10 that may be present. Such apparatus includes a pressure roller 34 formed from a metal cylinder 36 on which a layer 38 of elastomer material resistant to high temperature (about 200° C.) is carried. A layer 38 of soft, foam elastomer, such as silicone foam, is preferred so that suitable nip width can be formed at the fixing roller 10. It is preferred that the elastomer for layer 38 be a closed-cell type since the layer 38 will then hold a minimum amount of the offsetting preventive liquid. A supply core 40 and take-up core 42 for a web material 44 are provided. The web material 44 passes from the supply core 40 to the take-up core 42 via the pressure roller 34 and is arranged to engage a substantial portion of the circumferential surface of the pressure roller 34 serving to minimize any slippage between the web material 44 and the roller 34. The roller 34 is driven counterclockwise by a motor drive 46 which also drives the take-up core 42 counterclockwise via a slip clutch 48. This arrangement serves to move the web 44 relative to the fixing roller 10 so that toner material is brought to the nip between the fixing roller 10 and pressure roller 34 in a direction opposite to the direction of movement of the web material 44 so that toner material removed from the fixing roller 10 by the web material 44 will not be carried through the nip. The take-up roll 42 is driven at a slightly higher speed than the pressure roller 34 to provide web tension (about 0.9 to 1.8 kilogram) at a level sufficient to prevent web slippage on the pressure roller 34. The web 44 moves at a constant speed of about 5 centimeters per 200 to 1000 copies. Accordingly, 25 meters of web material 44 is sufficient for 100,000 to 200,000 copies. Selecting a web of thin material (1 to 2 mm) will allow an adequate quantity of web material 44 to be conveniently carried on the supply core 40.

The web 44 can be made of thin cloth or paper capable of being easily wetted at one of its surfaces with a thin even coat of an offset preventing material, such as silicone oil, applied to such surface by an offset preventive liquid applicator means which can include an applicator member such as a wick, roller, or squeeges, etc. In the arrangement shown in FIG. 1 of the drawing, an offset preventive liquid applicator means includes a reservoir 52 and a wick 50. The wick 50 extends into the silicone oil provided in the reservoir 52 and is positioned in contact with one surface of the web 44 as it begins its passage in contact with the pressure roller 34. The material used for the web 44 must also be capable, after such wetting, of wiping any residual toner material from the surface of the fixing roller 10. It's wet strength must be adequate to allow the 1.8 kilogram tension mentioned earlier. In addition, the material for the web 44 must resist fraying, wrinkling, and scorching when the fixing roller 10 is a heated roller. The web material should be smooth, but slightly coarse to remove and hold toner material removed from the surface of the fusing roller 10. Nonwoven rayon, nylon and polyester, as well as some paper products are suitable for forming the web 44. The particular characteristics of any material selected will determine how fast the web may travel and the degree of contact needed between the wick 50 and the web 44.

The arrangement described, wherein the web 44 is dry as it leaves the supply core 40 and is contacted by wick 50 for application of silicone oil to the web surface, allows low viscosity oil (up to 500 centistokes) to be used which is desirable as it is easier to apply and also cleans and oils the surface of the fixing roller 10 more effectively than higher viscosity oils.

As has been indicated, the pressure roller 34 serves to provide a back-up surface for the web 44. This allows the wick 50 to be positioned to make firm, uniform contact with the web 44 so that the web will be wetted with oil uniformly. The back-up surface for web 44 opposite the wick 50 can also be provided by a separate member (not shown), such as an elongate rod over which the web 44 is moved prior to reaching the nip. Use of a separate member to provide such back-up surface provides greater flexibility with respect to the location of the oil reservoir 52.

The wick 50 can be made of dacron or wool felt. The density and thickness of the material used determines the rate at which oil is applied to the web 44. Dacron having a thickness of about 3.2 mm with a density of 1.22 kilograms/square meters and wool having a thickness of about 4.8 mm and meeting SAE specifications per SAE F5 to F7 have been found to be suitable for making the wick 50. The size of the pressure roller 34, the thickness of the elastomer layer 38 and the position of roller 34 relative to the fixing roller 10 is selected to establish a force (about 2.73 kilograms) between the pressure roller 34 and the fixing roller 10 sufficient to provide a contact nip width between the fixing roller 10 and the pressure roller 34 of about 0.32 to 0.64 centimeters. Such a nip width has been found adequate for removal of toner material from the surface of fixing roller 10 and the application of a very thin film of silicone oil to the surface of the fixing roller 10. The soft material presented at the outer portion of the pressure roller serves to make the desired nip width possible. The silicone oil, in addition to serving as an offset preventing or release agent between the toner material and the fixing roller surface, also functions as a lubricant to minimize abrasion between the web 44 and the surface of the fixing roller 10.

The pressure roller 34, supply core 40 and take-up core 42 are carried by a frame 54, that is only partially shown in the drawing. The frame is rotatable in a clockwise direction so the web 44 can be moved to a position out of contact with the fixing roller 10. This avoids any scorching of the web 44 where the fixing roller 10 is heated to a high temperature and the web 44 is not moving. In addition, it prevents too much silicone oil from being transferred to the fusing roller 10 in the area making contact with the web 44 when the apparatus is not being used.

The wicking-distance, i.e., the distance between the top of the liquid in reservoir 52 and the point at which the wick contacts the web, has been discovered to be a factor with respect to the rate the liquid is applied to the web 44. It is desirable that the liquid level remain essentially constant to provide an essentially constant wicking distance and thereby provide additional control over the amount of offset preventive liquid that is supplied to roller 10. Unless the liquid in the reservoir 52 is checked frequently and refilled to a desired level, the wicking distance will vary substantially as the liquid supply is depleted. A level check and refill approach makes the liquid level maintenance problem apparatus operator dependent which is not satisfactory for maintaining an essentially constant wicking distance. An automatic liquid level maintenance arrangement, which requires minimal attention, is desirable. This is accomplished by using the arrangement shown in FIG. 2 to provide an offset preventive liquid applicator means which can be substituted for the basic reservoir 52, and wick 50 applicator means of FIG. 1.

Figure 2:
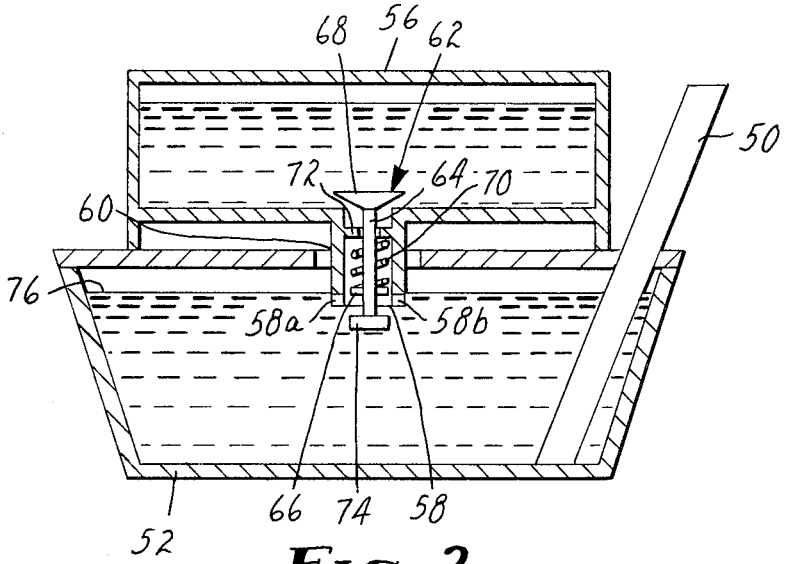
FIG. 2 is a diagramatic cross-sectional showing of a liquid applicator arrangement useable with the apparatus of FIG. 1.

The offset preventive liquid applicator means of FIG. 2 includes a reservoir 52 and a wick 50 and in addition includes a supply tank 56 that is positioned above the reservoir 52 for supplying offset preventive liquid to the reservoir 52. Except for an opening 58 from which the offset preventive liquid in the supply tank 56 can be allowed to flow, the supply tank is closed. The opening 58 is provided by the tank 56 so the opening 58 is positioned at the liquid level 76 desired in the reservoir 52 when the tank 56 is placed in position above the reservoir 52. When the liquid level in the reservoir 52 drops below the desired liquid level for reservoir 52, so the opening 58 is not closed off by the liquid in reservoir 52, air is allowed to enter the tank 56 via the opening 58 allowing liquid from tank 56 to flow into the reservoir 52 until the opening 58 is again closed off. As in the case of FIG. 1, a wick 50 has a portion which is received in the liquid contained in reservoir 52 with a portion extending from the reservoir 52 to provide a surface for contacting the web 44 as in the case of the wick 50 of FIG. 1.

The elements just described with respect to the offset liquid applicator means of FIG. 2 are the basic elements involved to provide a substantially constant liquid level in the reservoir 52. Other elements are utilized which simplify the handling of the supply tank 56 to position it above the reservoir 52. The supply tank 56 includes a tubular portion 60 which extends from the body of the tank 56, the free end of tubular portion 60 provides the opening 58. The opening 58 includes slots **58*a* and 58*b* in the wall of the tubular portion. The slots 58*a* and 58*b* extend a short distance from the end of the tubular portion 60 at opening 58 and toward the body of tank 56. A spring loaded valve assembly 62 is positioned within the tubular portion 60. The valve assembly 62 includes a stem portion 64 having a flange member 66 spaced from the body portion 68 of the valve assembly 62. A coil spring 70 is positioned about the stem portion 64 and is held in compression between the flange member 66 and a flange portion 72 of the tubular portion 60 causing the valve assembly to be in the closed position. This enables the supply tank 56 to be held with the tubular portion 60 pointed downwardly without loss of any liquid. The supply tank 56 is so positioned as it is put in place above the reservoir 52. A stop member 74 is provided in the reservoir 52 at a position where it is engaged by the free end portion of the valve stem portion 64 causing the valve assembly to be moved to an open position which is maintained while the supply tank 56 is in position above the reservoir 52. Assuming the liquid level then present in reservoir 52 does not close off the opening presented by slots 58*a* and 58*b*, air will be allowed to enter the tank 56 permitting liquid to flow from the tank into the reservoir 52 until the opening 58 including that portion of the opening provided by slots 58***a* and 58*b* are closed by the liquid. As liquid is removed by the wick 50 in its application of the liquid to web 44 (FIG. 1) the liquid level in reservoir 52 will drop until the opening provided by slots 58*a* and 58*b* is exposed so additional air can enter the supply tank 56 allowing liquid to move from the tank 56 into the reservoir to close off the slots 58*a* and 58*b* and thus maintain the liquid level in reservoir 52 at a substantially constant level. When the supply tank 56 is removed from servicing, the valve stem 64 is moved away from the stop member 74 in the reservoir 52 causing the valve assembly to move to a closed position by the expansion of coil spring 70.

While the oiler/cleaner apparatus that has been described for applying an offset preventing material and cleaning toner material from a heated fixing roller, it is also useable with contact fixing apparatus wherein the toner image is fixed by a pressure applied to the copy sheet as it is passed between a fixing roller and a back-up roller. A pressure fixing roller, which contacts the toner image, has a small amount of toner transferred to it which must be removed. The amount of toner transferred to the fixing roller is reduced by the application of a very thin layer of an offset preventing material, such as silicone oil, applied to the surface of the fixing roller.

While only two embodiments have been illustrated and described, it will be apparent to those skilled in the art that various modifications and improvements may be made without departing from the scope and spirit of the invention. Accordingly, it is to be understood that the invention is not to be limited by the illustrative embodiment, but only by the scope of the appended claims.

We claim:

1. Apparatus for removing toner material offset to a rotatable fixing roller and applying offset preventing liquid to the fixing roller including:

a supply core;

a rotatable take-up core;

a rotatable pressure roller having an outer layer of resilient material;

a web member adapted to be moved from said supply core to said take-up core via said pressure roller, said pressure roller positioned to provide a contact nip for said web member with the fixing roller opposite said pressure roller wherein contact of said web member with the fixing roller at said contact nip removes toner material offset to the fixing roller; and an offset preventing liquid applicator means positioned between said supply core and said contact nip for applying offset preventing liquid to the surface of said web member that is brought into contact with the fixing roller.

2. The apparatus according to claim 1 wherein said pressure roller and said take-up core are adapted to be driven, said take-up core adapted to be driven via a slip clutch and at a speed greater than the speed of said pressure roller whereby tension is provided on said web member sufficient to prevent slippage of said web member relative to said pressure roller.

3. The apparatus according to claim 1 or 2 wherein said pressure roller and said take-up core are adapted to be rotated relative to the direction of rotation of said fixing roller for moving said web member in a direction opposite to the movement of the fixing roller at said contact nip.

4. The apparatus according to claim 1 wherein said resilient material is a closed-cell material.

5. The apparatus according to claim 1 wherein said offset preventing liquid applicator means for applying offset preventive liquid to said web member includes a reservoir for holding a supply of offset preventing liquid and a wick member extending from within said reservoir supply to a position of contact with said surface of said web member that is brought into contact with said fixing roller.

6. The apparatus according to claim 5 wherein said wick member contacts said surface of said web member that is brought into contact with said fixing roller opposite an area where said web member is in contact with said pressure roller.

7. The apparatus according to claim 5 wherein said apparatus further includes a back-up member contacting said web member between said supply core and said nip on the web surface that is brought into contact with said pressure roller; and said wick member contacts said surface of said web member that is brought into contact with said fixing an area where said web member is in contact with said back-up member.

8. The apparatus according to claim 1 wherein the width of said contact nip is about 0.32 to 0.64 centimeters and a force of about 2.2 kilograms exists between said pressure roller and said fixing roller.

9. The apparatus according to claim 1 wherein said offset preventing liquid applicator means for applying offset preventive liquid to said web member includes a reservoir for holding a supply of offset preventing liquid, a wick member extending from within said reservoir supply to a position of contact with one surface of said web member and a supply tank for offset preventing liquid positioned above said reservoir, said supply tank having an opening positioned within said reservoir at a desired level for offset preventing liquid supplied to the reservoir.

10. The apparatus according to claim 9 wherein the supply tank includes a tubular member that extends from said supply tank, said tubular member providing said opening for said supply tank, a valve assembly positioned within said tubular member between said opening and said supply tank, said valve assembly including a spring biasing said valve assembly to a closed position, a stop member positioned in said reservoir for engagement by said valve assembly to operate said valve assembly to the open position when said supply tank is positioned above said reservoir to bring said valve assembly into engagement with said stop member.

* * * * *

UNITED STATES PATENT AND TRADEMARK OFFICE

CERTIFICATE OF CORRECTION

PATENT NO. : 4,393,804

DATED : July 19, 1983

INVENTOR(S) : James C. Nygard, Melvin P. Weiss and Thomas E. Larsen

It is certified that error appears in the above—identified patent and that said Letters Patent is hereby corrected as shown below:

Claim 7 (column 8), line 32, after "fixing" insert -- roller opposite --.

Signed and Sealed this

Fourth Day of October 1983

[SEAL]

*Attest:*

GERALD J. MOSSINGHOFF

*Attesting Officer*

*Commissioner of Patents and Trademarks*